US008328878B2

(12) United States Patent
Zhang

(10) Patent No.: US 8,328,878 B2
(45) Date of Patent: Dec. 11, 2012

(54) YARN OF ANIMAL COLLAGEN FIBER AND MANUFACTURE PROCESS THEREOF

(76) Inventor: Liwen Zhang, Guangzhou (CN)

( * ) Notice: Subject to any disclaimer, the term of this patent is extended or adjusted under 35 U.S.C. 154(b) by 977 days.

(21) Appl. No.: 10/599,027

(22) PCT Filed: Mar. 7, 2005

(86) PCT No.: PCT/CN2005/000266

§ 371 (c)(1),
(2), (4) Date: Sep. 18, 2006

(87) PCT Pub. No.: WO2005/100655

PCT Pub. Date: Oct. 27, 2005

(65) Prior Publication Data

US 2007/0186352 A1 Aug. 16, 2007

(30) Foreign Application Priority Data

Apr. 10, 2004 (CN) ..... 2004 1 0034435

(51) Int. Cl.
*D01C 3/00* (2006.01)
*D06M 13/42* (2006.01)

(52) U.S. Cl. ..... 8/94.11; 8/94.1 R; 252/8.81; 252/8.85

(58) Field of Classification Search ..... 8/94.11; 252/8.81, 8.85
See application file for complete search history.

(56) References Cited

U.S. PATENT DOCUMENTS

| | | | | | |
|---|---|---|---|---|---|
| 1,585,613 | A | * | 5/1926 | Heany | 57/235 |
| 3,255,580 | A | * | 6/1966 | Garner et al. | 57/254 |
| 3,314,861 | A | * | 4/1967 | Fujii | 435/68.1 |
| 3,607,609 | A | * | 9/1971 | Bogdanovicz et al. | 442/152 |
| 3,616,169 | A | * | 10/1971 | Okamura | 442/377 |
| 4,147,511 | A | * | 4/1979 | Bartlett | 8/94.18 |
| 4,404,033 | A | * | 9/1983 | Steffan | 106/124.3 |
| 5,851,290 | A | | 12/1998 | Fofonoff et al. | |
| 6,160,096 | A | * | 12/2000 | Sakashita et al. | 530/356 |
| 2002/0104305 | A1 | * | 8/2002 | Foster et al. | 57/332 |
| 2004/0073010 | A1 | * | 4/2004 | Ueda et al. | 530/356 |

FOREIGN PATENT DOCUMENTS

| | | | |
|---|---|---|---|
| CN | 1446961 | A | 10/2003 |
| EP | 1229156 | A | 8/2002 |
| JP | 7-97714 | A | 4/1995 |

* cited by examiner

*Primary Examiner* — Harold Pyon
*Assistant Examiner* — Katie L Hammer
(74) *Attorney, Agent, or Firm* — Global IP Services; Tianhua Gu

(57) ABSTRACT

A kind of yarn of animal collagen fiber and the manufacture process thereof, characterized in that the yarn is made of 1-100 WT % of collagen fiber of animal leather, and 0-99 WT % of textile fiber. The yarn of animal collagen fiber is made by the following procedure: choosing raw materials, loosing fiber, assorting, blending, carding, drawing, and twisting, if using the rawhide, the above procedure should add the steps of liming, washing, deliming, tanning and dehydrating. The raw material of the yarn can be the rawhide of any animal, as well as the leftover material or worn-out leather. The yarn has excellent properties, high tensile strength, abrasion resistance, softness, water adsorbent, oil adsorbent, flame-retardant, and can be woven, knitted and braided. The yarn can be used to weave high quality fabric with high count and high strength for four seasons, which greatly broadens the application fields of animal leather, improves the utilization of the leather and provides a kind of spinnable fiber for the textile industry. Therefore, the present invention can be widely used in textile industry.

14 Claims, 1 Drawing Sheet

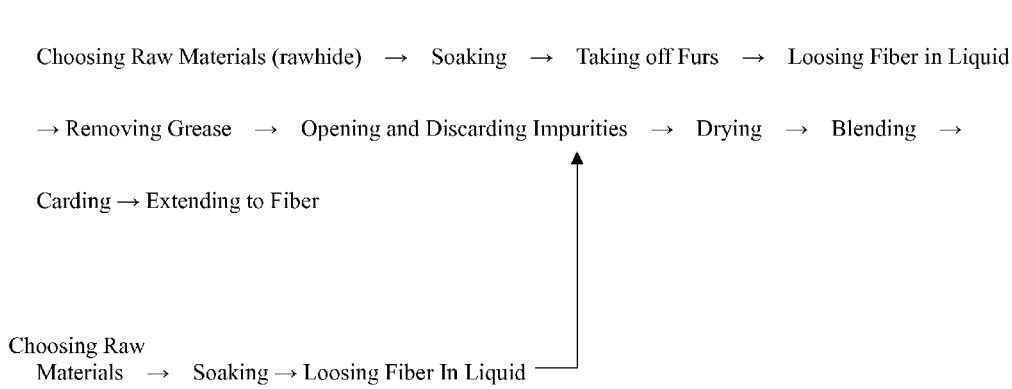

YARN OF COLLAGEN FIBER OF ANIMAL LEATHER AND THE MANUFACTURE PROCESS THEREOF

Choosing Raw Materials (rawhide) → Soaking → Taking off Furs → Loosing Fiber in Liquid → Removing Grease → Opening and Discarding Impurities → Drying → Blending → Carding → Extending to Fiber Choosing Raw Materials → Soaking → Loosing Fiber In Liquid

YARN OF ANIMAL COLLAGEN FIBER AND MANUFACTURE PROCESS THEREOF

FIELD OF THE INVENTION

The present invention relates to a kind of yarn, which is made of collagen fiber of animal leather or skin, and the manufacture process thereof.

BACKGROUND OF THE INVENTION

According to the structure and the shape, yarns are classified into staple yarns, filament yarns, and composite yarns including staple yarns and filament yarns. Wherein, the staple yarns are fiber aggregate with a particular linear density and a particulate twist, arraying orderly in a longitudinal direction, formed by many spinnable natural or synthetic short fibers with different length via procedures of loosing, carding and drawing for weaving various knitting textiles. Presently, the natural fiber sources are limited by nature, high cost and relative low abrasion resistance and tensile strength, and the synthetic fibers are poor in water adsorbent, comfort and flame-retardant. The textile industry urgently demands a kind of satisfying natural fibers.

Leather is manufactured by skin peeled off from an animal body treated with a series of physical mechanic and chemical methods, followed by tanning to form materials resistant to bacteria effect and abrasion, i.e. materials which are constant and resistant to decay and disruption. Prior to tanning, it is skin and rawhide. There are a great number of types of skin, which is a very complex biological tissue. However, the structures of them are similar and are made up of an epidermal layer, a subdermal layer and an endermic tissue lay. The thickness of the epidermal lay is 0.5-5 percent and is formed by arranging cells with various shapes. The thickness of subdermal layer is more than 90 percent and is dense connective tissue, basically formed by weaving collagen fibers and trace amount of elastic fibers and reticular fibers, wherein the collagen fiber is between 95 and 98 percent. The final leather is produced by processing the real skin. The tissue structure of the collagen fibers is arranged as follows: peptide chain-nascent fibril-fiber filament-fibril-microfibril-fiber-fiber bundles. The concept of the collagen fiber according to the present invention means collagen fiber bundles. The subdermal layer, which is basically made up of loosely weaved collagen fibers and trace amount of elastic fiber, is a loose tissue which links the skin and the body of an animal. It is the subdermal layer that the skin is peeled off from the animal. The subdermal layer is removed during the procedure of leather-making, but it is an excellent raw material in the present technology. Other than being woven, the collagen fibers in the subdermal layer are conglutinated and adhered by fiber matrix. Although a great part of fiber matrix is removed during the process of the leather-making, part of fiber matrix still remains. In addition, during the procedure of leather-making, chemical substances, such as acids and bases, and the like have to be used repeatedly to make the surface of the collagen fiber gelled. These fiber matrix-like materials in liquid state function as lubrication, but form adhesives under dry natural state. Therefore, whether it is animal skin or rawhide, collagen fibers not only exist in great amount, but also have much higher adhesive forces than the tensile strength of the collagen fibers under dry natural state. Additionally, the density of adhesive points of collagen fibers in the leather reaches 1~2 mm apart. The natural weaving structure of collagen fiber in real skin is that the thicker fiber bundles sometimes are divided into several strands of thinner fiber bundles and the resulting thinner fiber bundles sometimes incorporate other fiber bundles to form another larger fiber bundle. In such way, a special tridimensional reticular structure is formed by alternant division and incorporation, intertwining, without the beginning and the end. That collagen fibers are capable to form bundles is one of characteristics which differ from other textile fibers and non-woven fabric and textiles prepared by the same. Therefore, if the leather is loosened by an opener with a single beater or multiple beaters used in the procedure of cotton or wool and non-woven fabric in the current technology or thread waste opener used in processing reused cotton, the collagen fibers are transformed into powder with the length lower than 4 mm, not reaching the length required for spinning. However, for leathers prepared by tanned belly skin, for example cattle, in which the woven of collagen fibers are loose and endermic tissue lays which are removed in the leather-making industry, they can be processed to form dispersing collagen fibers with single strand and without interconnection by using above described various openers. However, the collagen fibers obtained by the method mentioned above are still short, poor in spinnability, only used for producing low-level textiles or as the raw materials for "waste textile".

The skins of animals are currently used in leather-making. During the leather-making process, only 20-40 percent rawhide is finally processed to form leather, the rest becomes leftover wastes due to various defects, such as brand, crimple, hurt by grass thorns present in rawhide and other reasons. Additionally, a great mount of fractional materials generated during processing the leather products makes the availability of the sources very low. Recently, some leftover materials are opened or smashed under natural state using the current technology to obtain non-spinning fractional fibers with the length lower than several millimeters, and the resulting fractional fibers conjugate other raw materials to produce low value-added products, such as non-woven fabric and regenerated leather, and so on. China Patent application No. 03114089.0 published on Oct. 8, 2003 disclosed a method for preparing real skin filament. However, the yarns described by the said application were prepared by conglutinating the real skin fibers with adhesive solution, which do not belong the same type of products as the yarns processed by the procedure described in the present invention. Additionally, the description of the method is too simple to disclose sufficiently such that persons skilled in the art cannot achieve.

SUMMARY OF THE INVENTION

The object of the present invention is to provide a kind of yarn of animal collagen fiber of animal leather or skin, and manufacture process thereof to resolve the problem that yarn is manufactured by using animal skins or leathers and leftover materials thereof as well as wasted leathers and improve the availability of animal skins and product level and broaden the application field of animal pelage. Meanwhile, the present invention provides a kind of yarn with higher tensile strength and better resistance abrasion than those of the natural fiber yarns, and with higher water absorption and more comfort and better flame-retardant property than those of synthetic fiber yarns for textile industry.

The object of the present invention is carried out as follows: the yarn is made of 1-100 WT % of animal collagen fiber, 0-99 WT % of textile fiber. The trace amount of elastic fibers, reticular fibers and other non-fiber substances remained in the leather sources will not influence yarns and will be ignored.

The animal collagen fiber is derived from at least one kind of animals, including the cattle, the sheep, the horse, the dog, the pig, the deer, the rabbit, the crocodile or snake, etc.

The textile fiber is at least one of spinnable natural fibers and synthetic fibers including cotton, hemp, wool, silk, terylene, acrylic, nylon, polyamide and viscose staple, etc.

There are two methods for manufacturing the yarn of animal collagen fiber: one is produced by using tanned leathers, comprising the following steps: choosing raw materials, loosing fibers, assorting, blending, carding, drawing, and twisting, and the other is produced by rawhides, comprising the following steps: choosing raw materials, liming, washing with water, deliming, tanning and softening, dehydrating, loosing fibers, assorting, blending, carding, drawing, and twisting.

The present invention has the following advantages: (1) yarns manufactured by the present invention can be woven, braided, knitted, greatly broadening the application field of animal pelage as natural resource and improving the utilization of leathers and simultaneously providing a kind of spinnable natural fibers; (2) animal collagen fibers are collagen protein, the clothes made up of which possess various excellent properties, such as excellent compatibility to human body, high tensile strength, resistance abrasion, soft, water adsorbent, oil adsorbent and flame retardant. The yarns are woven into not only durable coarse textile fabric, such as jean and solid nylon, but also high level cloth materials for four seasons; (3) there are various types: various types of novel products can be formed by selecting raw materials from different species of animals or mixtures of raw materials from different species of animals, and various composite yarns can be formed by mixing with other filament fibers or yarns; (4) raw materials are abundant: all leftover materials and wasted leathers resulting from leather-making and leather products and various animal rawhides, as well as endermic tissue lay skin and pelage of little animals and broken skins can be used, achieving the best use of everything and making waste profitable.

DESCRIPTION OF THE FIGURES

FIG. 1 is the flow chart showing producing yarns of animal collagen fiber.

DETAIL DESCRIPTION OF THE INVENTION

Example 1

The animal collagen fiber is 55 WT %, and textile fiber is 45 WT %. The yarn is made of animal collagen fiber and other textile fibers. The bunchy collagen fibers which are occasionally divided into several strands of thinner bunchy collagen fibers incorporate other textile fibers or other collagen fibers to form a kind of continuous blended fiber bundles, which are twisted as a blended fibers.

The flow processes: choosing raw materials—loosing fibers—assorting—blending—carding—drawing—twisting.

Description of the Working Procedure

1. Choosing raw materials: According to the above proportions, at least one of a tanned animal leather and leftover material thereof and wasted leather preparation is selected, wherein the animals include a bull, a sheep, a horse, a pig, a dog, a deer, a rabbit, a crocodile or a snake, and so on, and at least one of the synthetic textile fibers or natural textile fibers is selected.

2. Loosing fibers: Fibers are loosened by a reciprocating liquid opener. The reciprocating liquid opener can be self-made, in the container of which at least a beater used by an opening device and/or carding device used by carding machine is provided. The liquid in the liquid opener is water. Depending on the skin or leather sources, at least one of 0.2-2 percent (by weight of water) washing agent, 1-10 percent (by weight of water) lipid and product thereof, 0.2-1.5 percent (by weight of water) penetrating agent and 0.03-0.5 percent (by weight of water) basic substances is added into water in the liquid opener. The raw materials are adequately immerged in the above liquid by the function of reciprocating mechanical force applied by the beater to make the adhesive substances such as fiber matrix among the collagen fibers become lubricating agent again under the effect of the liquid and make the materials expanding. At the same time, the collagen fibers are loosened and slacked ceaselessly to finally obtain dispersing bunchy collagen fibers with a single strand and without interconnection, satisfying the length desired for spinning yarns.

3. Assorting: after desiccation or dried by a drying machine, the loosened dispersing collagen fibers are separated by wind coming from a vertical airflow box splitter used in processing feather & down or a self-made horizontal splitter so that longer fibers are distributed into a different zone from that of the shorter fibers by the function of airflow, then assorting according to the length of the fibers. Non-fiber materials, such as epidermal debris, enter another zone by the function of airflow to be removed.

4. Blending: fibers prepared by various leathers are selected according to the desire of products, 55 WT % collagen fiber from at least a type of animal leather and 45 WT % at least a kind of textile fibers. Current equipments, such as a multi-layer cotton mixing machine or a method for spreading horizontally and taking directly, can be used to blend them to achieve the object that the content of blending fibers is distributed correctly.

5. Carding: the well-blended fibers are carded by a carding machine to make the bunchy collagen fibers and textile fibers form continuous fiber assemble with a particular linear density which is homogeneously blended and arrayed orderly in longitudinal direction.

6. Drawing: A drawing machine used in cotton or wool procedure is used to draw and level the above fibers one to three times. Each above fiber is continuously extended to achieve the object for improving the uniformity of the fibers.

7. Twisting: according to the diameter of the collagen fiber, its length and requirement to the yarns, roller, abrasion, ring spindle and other procedures for novel spinning yarns are selected respectively to twist to form yarns.

Example 2

Animal collagen fibers are 100 WT %. The yarn is made of animal collagen fiber. The collagen fibers are bunchy in yarns and are occasionally divided into several strands of thinner bunchy collagen fibers. The thinner bunchy collagen fibers incorporate other collagen fibers. In this way, the bunchy collagen fibers, continuously separated and incorporated, form a strand of continuously twisted yarns of animal collagen fiber.

The flow processes: choosing raw materials—liming—washing with water—deliming—tanning and softening—dehydrating—loosing fiber—assorting—blending—carding—twisting.

Description of the Working Procedure

1. Choosing raw materials: At least one kind of animal rawhide is selected. The animal includes a bull, a sheep, a horse, a pig, a dog, a deer, a rabbit, a crocodile and a snake, and so on.

2. Liming: the method for liming with calcium hydroxide as the primary ingredient is used, adding 1-3 percent (weight of rawhide) sodium sulfate and 0.1-0.5 percent sodium hydroxide, wherein water is 1.5-2 times that of the rawhide. In order to saponify the grease in rawhide and simultaneously make the collagen fibers exceed the loosing degree desired for the leather-making process, the temperature for the liming solution is at 30-50 centigrade, and the time for soaking is 2-24 hours.

3. Washing with water: the saponified mixture was cleaned by ambient water at 30-40 centigrade, followed by washing with ambient water one to two times to make the pH value between 6.5-8.

4. deliming: adding 2-3 percent (by weight of hide) ammonium sulfate, 0.2-0.5 percent protease and 1-2 times of water. Soaking alternated with rolling at pH value between 3 and 6, and at the temperature between 35 and 40 centigrade for 1-2 hours to removing basic ions in hide and simultaneously further hydrolyze the fiber matrix of rawhide, fat and non-fiber protein. Then the impurities are removed with water. For the hide with furs, 3-4 percent (by weight of hide) alkali sulphide including 10-15 percent lime paste, 1-2 percent sodium hydroxide and 1-2 times of water, is added before liming. The furs are taken off from the hide when dipping for 2-16 hours, and then removed by washing.

5. Tanning and softening: the chrome tanning method or plant tanning method and other organic or mineral tanning method in the current technology is performed in the above said opener to make the hide reciprocating torn while tanned so that the collagen fibers are basically loosened. After tanned, the resulting raw materials are softened by emulsifiable solution and lipid to prevent from cohesion after dehydration.

6. Dehydrating: A wringing machine is used to make water content between 20-30 percent.

7. Loosing the fibers: Collagen fibers treated with above described processes are excessively loosened or basically form bunchy dispersing fibers, together with cohesion and winding occasionally. Therefore, the procedures for loosing fibers can be carried out to loosen the fibers in normal condition by using a trapeziform opener or a gill box rotary opener or a cutting machine with three cylinders used in cotton or wool procedures. The collagen fibers with partial cohesion or winding are completely loosened to form a single strand of bunchy dispersing collagen fibers with the length suitable for spinning and without cohesion.

8. Assorting: similar to that of example 1

9. Blending: 100 WT % collagen fiber is used. For improving spinnability, 0.1-8 percent (by weight of collagen fiber of animal leather or skin) oil agent was sprayed. The oil agents include animal oil, plant oil, wax, mineral oil, and synthetic lipids and products thereof. The remaining procedures are similar to those of Example 1.

The remaining procedures are similar to those of Example 1.

Example 3

The animal collagen fiber is 20 WT %, and textile fiber is 80 WT %.

The processing procedures are similar to those of Example 2.

Description of the Working Procedure

1. Choosing raw materials: Selecting wasted materials of rawhide edge or leftovers of gray skin prior to leather-making procedures or double layer skin unsuitable for leather-making or animal hides unsuitable leather-making and endermic tissue layer.

2. The procedures for liming, washing with water, tanning and softening, and dehydrating are similar to those of example 2.

3. The fiber filaments produced by the procedures of example 2 combine other filaments or yarns to twist to form mounting yarns or yarns having the above collagen fiber ingredients, the remaining procedures are similar to those of example 1.

The invention claimed is:

1. A process for manufacturing yarn of animal collagen fiber comprising:

(1) choosing tanned leathers as raw materials;

(2) loosing the tanned leathers to get collagen fibers, wherein the tanned leathers are loosened by a reciprocating liquid opener, which has a container, a beater and liquid, wherein the liquid comprises water and at least one substance added to the water comprising 0.2-2 percent (by weight of water) washing agent, 1-10 percent (by weight of water) lipid or product thereof, 0.2-1.5 percent (by weight of water) penetrating agent and 0.03-0.5 percent (by weight of water) basic substances, and said liquid expands the tanned leather materials;

(3) beating the tanned leather materials by said beater, adhesive substances of fiber matrix among the collagen fibers are beaten to become lubricating agent;

(4) assorting the collagen fibers;

(5) blending the collagen fibers with textile fibers;

(6) carding, drawing and twisting the blended collagen and textile fibers.

2. The process of claim 1, wherein the tanned leather materials are made by following steps: choosing rawhide materials, liming, washing with water, deliming, tanning and softening, dehydrating, loosing fibers, assorting, blending, carding, drawing, and twisting, wherein acid protease is used for deliming, and the pH value in the solution is controlled between 3 and 6.

3. The process of claim 1, wherein the assorting has steps including first separating the loosened dispersing collagen fibers by wind, distributing longer into a different zone from that of the shorter fibers by function of airflow, second assorting according to the length of the fibers.

4. The process of claim 1, wherein in the blend step a multi-layer cotton mixing machine is used for blending the collagen fibers and textile fibers.

5. The process of claim 1, wherein in the carding step a carding machine to make the collagen fibers and textile fibers as continuous fiber assemble with a particular linear density which is homogeneously blended and arrayed orderly in longitudinal direction.

6. The process of claim 1, wherein in the drawing step, a drawing machine is used to draw and level fibers one to three times, each fiber is continuously extended to achieve the object for improving the uniformity of the fibers.

7. The process of claim 1, wherein in the twisting according to diameter and length of the collagen fibers and requirements of spinning yarns select correct roller, abrasion, ring spindle and process for spinning yarns to twist the collagen fibers and textile fibers to form yarns.

8. The process of claim 2, wherein the liming step uses calcium hydroxide as the primary ingredient, adding 1-3 percent (weight of rawhide) sodium sulfate and 0.1-0.5 percent sodium hydroxide, water is 1.5-2 times that of the rawhide, the temperature for the liming solution is at 30-50 centigrade, and the time for soaking is 2-24 hours.

9. The process of claim 2, wherein for the washing step saponified mixtures are cleaned by ambient water at 30-40 centigrade, followed by washing with ambient water one to two times to make the pH value between 6.5-8.

10. The process of claim 2, wherein for the deliming step, adding 2-3 percent (by weight of hide) ammonium sulfate, 0.2-0.5 percent protease and 1-2 times of water, soaking alternated with rolling at pH value between 3 and 6, and at the temperature between 35 and 40 centigrade for 1-2 hours to removing basic ions in hide and simultaneously further hydrolyze the fiber matrix of rawhide, fat and non-fiber protein, then the impurities are removed with water, for the hide with furs, 3-4 percent (by weight of hide) alkali sulphide including 10-15 percent lime paste, 1-2 percent sodium hydroxide and 1-2 times of water, is added before liming, the furs are taken off from the hide when dipping for 2-16 hours, and then removed by washing.

11. The process of claim 2, wherein in the tanning and softening step, method of chrome tanning or plant tanning or organic tanning or mineral tanning is performed in the opener to make the hide be torn to and fro while tanning, so that the collagen fibers are basically loosened after tanned, the resulting loosened collagen fibers are softened by emulsifiable solution and lipid to prevent from cohesion after dehydration.

12. The process of claim 2, wherein a wringing machine is used to make water content between 20-30 percent.

13. The process of claim 2, wherein for the Loosing fibers step using a trapeziform opener or a gill box rotary opener or a cutting machine with three cylinders.

14. A process for manufacturing yarn of animal collagen fiber from hides comprising:

(1) choosing animal's skins as raw materials, tanning the animal's skins to become tanned leathers;

(2) loosing the tanned leathers to get collagen fibers, wherein the tanned leathers are loosened by a reciprocating liquid opener, which has a container, a beater and liquid, wherein the liquid comprises water and at least one substance added to the water comprising 0.2-2 percent (by weight of water) washing agent, 1-10 percent (by weight of water) lipid or product thereof, 0.2-1.5 percent (by weight of water) penetrating agent and 0.03-0.5 percent (by weight of water) basic substances, and said liquid expands the tanned leather materials;

(3) beating the tanned leather materials by said beater, adhesive substances of fiber matrix among the collagen fibers are beaten to become lubricating agent;

(4) assorting the collagen fibers;

(5) blending the collagen fibers with textile fibers;

(6) carding, drawing and twisting the blended collagen and textile fibers.

* * * * *